United States Patent [19]

Bäuerle

[11] 4,252,399

[45] Feb. 24, 1981

[54] ELECTRICAL SOCKET CONTACT

[75] Inventor: Gerhard Bäuerle, Obersulm, Fed. Rep. of Germany

[73] Assignee: Bunker Ramo Corporation, Oak Brook, Ill.

[21] Appl. No.: 21,133

[22] Filed: Mar. 16, 1979

[30] Foreign Application Priority Data

Mar. 17, 1978 [DE] Fed. Rep. of Germany ..... 2811774

[51] Int. Cl.[3] ..... H01R 11/22; H01R 4/28

[52] U.S. Cl. ..... 339/256 R; 339/217 S

[58] Field of Search ..... 339/217 R, 217 J, 256 R, 339/217 S, 217 PS

[56] References Cited

U.S. PATENT DOCUMENTS

| | | | |
|---|---|---|---|
| 3,325,775 | 7/1967 | Zak | 339/217 S X |
| 3,513,438 | 5/1970 | Henschen | 339/217 S |
| 3,530,428 | 9/1970 | Zak | 339/217 |
| 3,562,698 | 2/1971 | Merry | 339/256 R X |
| 3,581,271 | 5/1971 | Knitter | 339/256 R X |
| 4,006,961 | 2/1977 | Langenbach | 339/217 S |
| 4,046,450 | 9/1977 | Yurtin | 339/217 S |

FOREIGN PATENT DOCUMENTS

| | | | |
|---|---|---|---|
| 1615085 | 6/1970 | Fed. Rep. of Germany . | |
| 1956181 | 9/1970 | Fed. Rep. of Germany . | |
| 1224474 | 6/1960 | France . | |
| 1473592 | 3/1967 | France . | |
| 1601837 | 10/1970 | France . | |
| 2344978 | 10/1977 | France | 339/217 S |

*Primary Examiner*—John McQuade
*Assistant Examiner*—John S. Brown
*Attorney, Agent, or Firm*—F. M. Arbuckle; J. R. Hoffman

[57] ABSTRACT

An electrical terminal or contact element for use in an electrical connector, having a resilient tab for retaining the element in the connector housing. The tab is attached to a central portion of the element and extends diagonally through the center of the element at an acute angle to the longitudinal axis of the element. A free end of the tab extends beyond the element for engaging a shoulder of the housing after the element is inserted through a passageway in the housing. The free end of the tab may be deflected inwardly by means of a pin-like tool to disengage the tab from the shoulder and allow removal of the element from the housing. A stop surface in the central portion of the element prevents deflection of the tab beyond its elastic limit, thereby preventing damage to the terminal element.

5 Claims, 6 Drawing Figures

ELECTRICAL SOCKET CONTACT

TECHNICAL FIELD

The present invention relates to an electrical contact element of the type having a resilient locking tab for retaining the contact in a connector housing.

BACKGROUND OF THE PRIOR ART

An electrical contact of this type is known from U.S. Pat. No. 3,530,428. The known socket contact comprises a contact member with an axial plug-in aperture for receiving a mating contact pin. The contact member is connected to a central portion used to attach the socket contact to an insulating housing. The socket contact end furthest from the contact member forms a connecting portion to which a conductor can be connected. In order to prevent the socket contact from sliding in the insulating housing in the axial direction, the central portion is provided with a locking tab which is slotted from the socket contact material. This tab is supported by the central portion on one side, and extends through the interior of the socket contact under an acute angle relative to the socket contact. The free end of the locking tab projects through a slotted opening on the opposite side of the socket contact. When the socket contact is not inserted in an insulating housing, the free end of the locking tab projects over the outer periphery of the socket contact. When the socket contact is pushed into a chamber of an insulating housing, the locking tab is forced inward and snaps behind a shoulder provided in the insulating housing, whereupon the tab returns outwardly over a small distance. In order to remove the socket contact from the insulating housing, a pin-shaped removing tool is inserted into the plug-in aperture of the contact portion; the end of the tool rests on the locking tab and urges it inward. When the locking tab has been urged far enough inward, the locking tab becomes permanently deformed and does not return into its initial position. The deformed contact can no longer be used, because it cannot return into the locked position inside the contact chamber of the insulating housing.

The goal of the invention is to develop an electrical socket contact of the above-specified kind so that a permanent deformation of the locking tab cannot occur when the socket contact is removed from its housing.

BRIEF SUMMARY OF THE INVENTION

In the socket contact of the invention the locking tab is prevented from bending farther than necessary into the interior of the socket contact. The range over which the locking tab can be bent can be adjusted by choosing the spacing of the stop from the longitudinal axis of the socket contact so that the spacing suffices for the socket contact to be pushed out. This configuration guarantees that the locking tab functions properly even when the socket contact has been removed and reinserted several times. The socket contact of the invention can be easily removed from a contact chamber of an insulating housing. A pin is pushed into the entry opening of the contact portion until the end of the pin rests on the locking tab and depresses the same to the stop. In this position the locking tab provides a resistance which suffices for pushing the socket contact out of the insulating housing. Another important advantage of this socket contact is that the socket contact can be employed in insulating housings having "closed-entry" openings defined as openings restricting the plug-in aperture to a cross section preventing a countercontact from being applied off center to the front face of the socket contact and from deforming the socket contact. Known socket contacts often cannot be employed in such insulating housings because special removal tools having shoulders with a diameter exceeding the cross section of the "closed-entry" opening are required. Furthermore, it is not necessary to use a special removal tool but rather any thin pin may be employed.

In a preferred embodiment of the invention, the free end of the locking tab is bent and extends approximatelyparallel to the axis of the socket contact. This configuration guarantees that the end of the contact tab rests smoothly on the stop and is subjected to axial forces mainly in the longitudinal direction. The strength of the locking tab is therefore increasd.

When the contact portion, the central portion, and the conductor-connecting portion of the socket contact are obtained by milling operations, a transverse opening is conveniently applied to the central portion, and the locking tab is provided with a clamp attached to the central portion. This lock-in configuration can be employed in the case of a slotted socket contact, as well as in the case of a socket contact obtained by milling.

BRIEF DESCRIPTION OF THE DRAWINGS

Exemplary embodiments of the invention will now be described in detail with reference to the drawings.

DETAILED DESCRIPTION OF THE INVENTION

Figure 1:
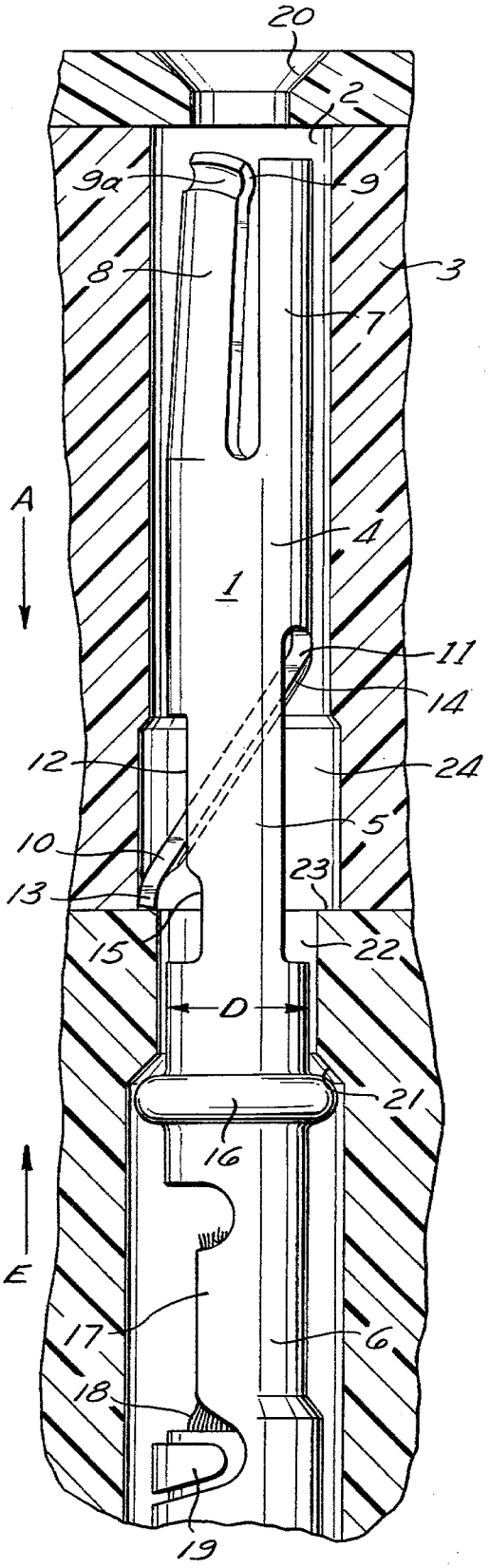
FIG. 1 is a longitudinal cross section of a first embodiment of a socket contact according to the invention, which is in the locked position in the contact chamber of an insulating housing.

FIG. 1 shows a socket contact 1 inserted into a contact chamber 2 of an insulating housing 3. The electrical socket contact 1 comprises a contact portion 4, a central portion 5, and a conductor-connecting portion 6.

The end of the contact portion 4 is provided with a semi-cylindrical contact ridge 7 which is faced by two substantially quarter-cylindrical contact springs 8. Bevelled guiding sections 9 are provided on the contact springs 8 in the zone of the entry opening. The contact springs 8 have inwardly biased, spoon-shaped contact surfaces 9*a* which guarantee good contact with a pin to be inserted into the entry opening.

Figure 2:
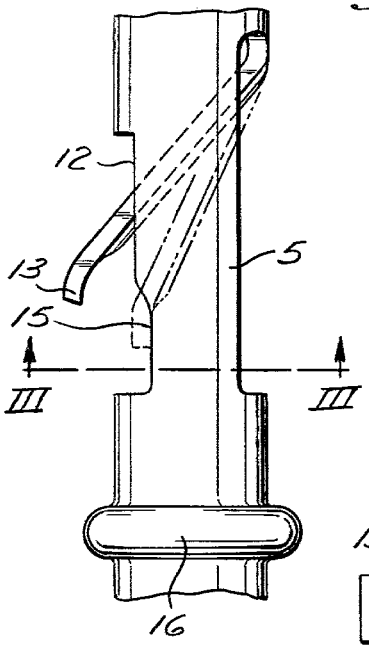
FIG. 2 is a partial view of the socket contact of FIG. 1 and shows the socket contact without the insulating housing and the locking tab in the outermost biased position.
Figure 3:
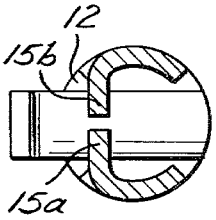
FIG. 3 is a cross section along line III—III of the socket contact shown in FIG. 2.

The central portion 5 of socket contact 1 provides a firm seat of the socket contact inside contact chamber 2 of insulating housing 3. A locking tongue or locking tab 10 is supported on one side of socket contact 1 (right side in FIG. 1) at a bend point 11 and extends diagonally through the interior of central portion 5; an acute angle is included with the longitudinal axis of socket contact 1. The free end of locking tab 10 extends on the opposite side of central portion 5 through an opening 12. The front end of locking tab 10 is bent to form an angular section 13 which is substantially parallel to the longitudinal axis of socket contact 1. Locking tab 10 has a cross section profile in the form of the curved ridge which is denoted by 14 in the drawings. The profile of the cross section increases the flexural rigidity of the locking tab without impairing its elasticity. A stop 15 is formed in the central section 5 within the range of movement of angular section 13. As can be inferred particularly from FIG. 3, stop 15 consists of two radially inwardly offset protrusions 15*a* and 15*b* which were punched from the material of socket contact 1 and bent radially and inwardly. Stop 15 is configured relative to the outer diameter of socket contact 1 so that the angular section 13 of locking tab 10 snaps behind the outer periphery of the socket contact in the state of retention. This allows easy removal of the socket contact and minimizes the total range of rotation of the locking tab. FIG. 2 shows the two extreme positions which can be reached by locking tab 10.

Central portion 5 is followed by conductor-connecting portion 6 with claws 17 used to grip and clamp the end of an electrical conductor 18 from which the insulation was removed. Clamping lugs 18 are provided and embrace an insulated portion of the conductor.

The following is a description of the insertion and removal of the socket contact of the invention in the contact chamber 2 of the insulating housing 3. On the side on which the connection is established, contact chamber 2 has a narrow entry opening 20 in the form of a funnel to facilitate the introduction of a plug pin. The advantage of the narrow entry opening is that a pin introduced into chamber 2 cannot deform the ends of the contact portion. Socket contact 1 is inserted into the contact chamber 2 in the direction of arrow E and from the side of the conductor. The free end of locking tab 10 which extends through opening 12 is urged inward by the wall of contact chamber 2 during the insertion. The angular section 13 of locking tab 10 passes over a conical guiding ramp 21 which is followed by a constricted region 22 of insulating housing 2. The other end of the constricted region 22 is formed by an annular radial shoulder 23 which is followed by a section 24 of enlarged diameter. Once the socket contact has reached the position shown in FIG. 1, the free end 13 of locking tab 10 snaps radially outwardly to lock behind radial shoulder 23. At the same time the insertion is stopped by bead or flange 16 engaging with conical guiding ramp 21. In this manner the axial position of the socket contact is fixed.

When socket contact 1 is to be removed from the contact chamber 2 with the aid of a removing tool, a pin is inserted into the contact opening. The pin rests on locking tab 10 and urges the free end thereof inward until angular section 13 engages stop 15. Then locking tab 10 offers sufficient resistance so that the entire socket contact is urged out of the chamber in the direction of arrow A when the pin is pushed further inward. While the socket contact is removed, locking tab 10 assumes the position indicated in FIG. 2 by the dashed lines.

Figure 4:
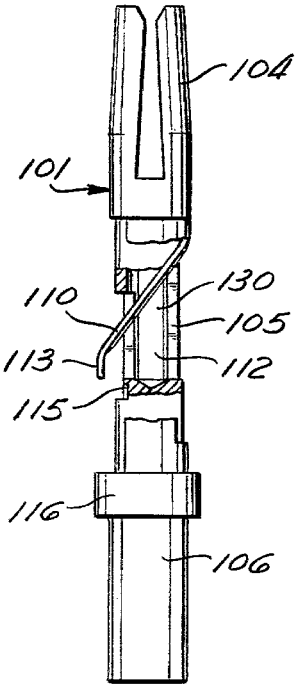
FIG. 4 is a partially cut longitudinal cross section of a second embodiment of a socket contact according to the invention.
Figure 5:
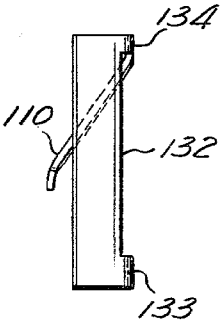
FIG. 5 is a lateral cross section of the locking tab member with the clamping jaw as partially shown in FIG. 4.
Figure 6:
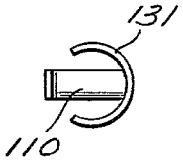
FIG. 6 is a top view of the locking tab member shown in FIG. 5.

The following describes a second embodiment of the invention, which is shown in FIGS. 4—6. FIG. 4 shows a socket contact 101 which was obtained by milling and which comprises a contact portion 104, a central portion 105, and a conductor-connecting portion 106. The outer diameter of central portion 105 is slightly smaller than the outer diameter of contact portion 104. A bore 130 partially penetrates central portion 105 in the axial direction. A central slit 112 is provided in central portion 105; a locking tab 110 extends through slit 112 under an acute angle relative to the axis of the socket contact. The free end of locking tab 110 comprises an angular section 113 which extends substantially parallel to the axis of the socket contact. That end of slit 112, which is close to the side of the conductor connection, is followed by a stop 115 which forms the inward limit of the range of rotation of the free end of the locking tab. As can be inferred particularly from FIGS. 5 and 6, locking tab 110 forms part of a clamping portion 131 which can snap on central portion 105 of socket contact 101. The clamping portion comprises basically a C-shaped sheet metal mantle in which the locking tab 110 was obtained by punching, so that an aperture 132 results. Webs 133 and 134 form continuations of the upper and lower ends of aperture 132. The reduced diameter of central portion 105 is chosen so that the surface of clamping portion 131 is flush with the outer surface of contact portion 104 in the assembled state.

The milled socket contact with the attached clamping portion is inserted and removed as in the case of the first embodiment. When inserted, the axial position of socket contact 101 is determined and fixed by flange 116 and locking tab 110 which protrudes behind the radial shoulder inside a contact chamber.

From the foregoing, it can be readily realized that this invention can assume various embodiments. Thus, it is to be understood that the invention is not limited to the specific embodiments described herein, but is to be limited only by the appended claims.

What is claimed is:

1. An electrical contact element comprising: a contact portion having an axially extending contact receiving aperture; a central portion coupled to said contact portion and having an axially extending aperture extending from said contact aperture; a conductor terminating portion including means for terminating an electrical conductor; said central portion including a resilient locking tab coupled to one side thereof and extending therethrough across said central portion aperture at an acute angle to the longitudinal axis of said central portion so as to be accessible through said contact aperture, said tab having a free end projecting through an opening in said central portion opposite said one side; and said central portion further including means at the edge of said opening adjacent to said free end of said resilient locking tab for preventing movement of said tab back across said central portion aperture beyond its elastic limit.

2. A contact element according to claim 1, wherein said movement preventing means is a stop offset relative to the outer diameter of said contact element by a distance such that said resilient locking tab does not project beyond the outer periphery of said contact portion when in a release position.

3. A contact element according to claim 1 or claim 2, wherein said resilient locking tab has a profiled cross section.

4. A contact element according to claim 1 or claim 2, wherein said free end of said resilient locking tab is bent and extends approximately parallel to the axis of said contact element.

5. A contact element according to claim 1, wherein said contact portion, said central portion, and said conductor terminating portion of said contact element are obtained by milling, and wherein said central portion includes a transverse opening and said resilient locking tab includes clamping means for engaging said central portion.

* * * * *